United States Patent [19]

Wissmann et al.

[11] Patent Number: 4,709,669

[45] Date of Patent: Dec. 1, 1987

[54] IGNITION ARRANGEMENT FOR AN INTERNAL COMBUSTION ENGINE OF A HANDHELD PORTABLE TOOL

[75] Inventors: Michael Wissmann, Schorndorf-Weiler; Jürgen Weber, Waiblingen; Hans Nickel, Cottenweiler, all of Fed. Rep. of Germany

[73] Assignee: Andreas Stihl, Waiblingen, Fed. Rep. of Germany

[21] Appl. No.: 907,045

[22] Filed: Sep. 12, 1986

[30] Foreign Application Priority Data

Oct. 4, 1985 [DE] Fed. Rep. of Germany ..... 3535477

[51] Int. Cl.[4] ..... F02P 3/00

[52] U.S. Cl. ..... 123/149 D; 310/168; 123/599; 123/601

[58] Field of Search ..... 123/599, 601, 149 D; 310/168, 169, 170

[56] References Cited

U.S. PATENT DOCUMENTS

| | | | |
|---|---|---|---|
| 3,508,116 | 4/1970 | Burson | 123/149 D |
| 3,747,582 | 7/1973 | Kato | 123/149 D |
| 3,747,649 | 7/1973 | Densow | 123/149 D |
| 3,765,390 | 10/1973 | Loudon | 123/149 D |
| 4,195,241 | 3/1980 | Moller | 123/149 D |

*Primary Examiner*—Ronald B. Cox

*Attorney, Agent, or Firm*—Walter Ottesen

[57] ABSTRACT

The invention is directed to an ignition arrangement for an internal combustion engine of a handheld portable tool such as a chain saw or the like. The engine has a crankshaft and a fan wheel is seated on the crankshaft for rotation therewith. The ignition arrangement includes a permanent magnet. The magnet has two pole shoes and an exciter coil is mounted on the permanent magnet. The permanent magnet equipped in this way is fixedly mounted on the tool to save weight. A relatively light self-supporting annular member with projections is mounted in the fan wheel. The projections of the annular member and the permanent magnet with its pole shoes conjointly define a magnetic circuit. As the projections pass the pole shoes at a minimal spacing therefrom during operation of the engine, the projections alternately open and close the magnetic circuit thereby causing changes in the flux of this circuit. The flux changes cause a voltage to be inducted in the exciter coil which serves to generate the igniting spark via an appropriate electronic circuit.

17 Claims, 7 Drawing Figures

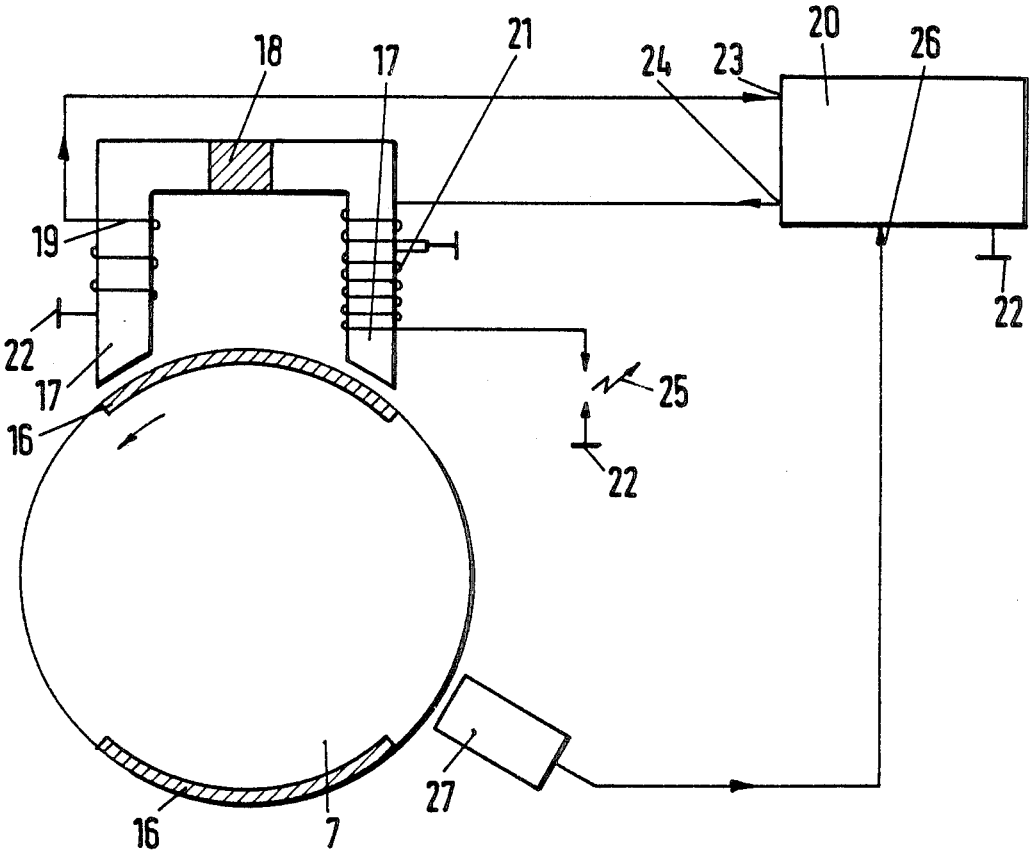
Fig.7
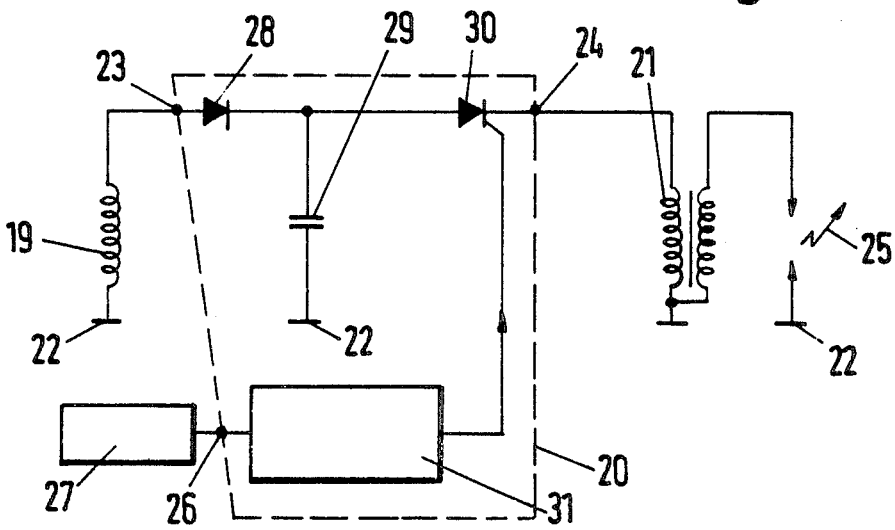

IGNITION ARRANGEMENT FOR AN INTERNAL COMBUSTION ENGINE OF A HANDHELD PORTABLE TOOL

FIELD OF THE INVENTION

The invention relates to a portable handheld tool, such as a motor-driven chain saw or the like that is powered by an internal combustion engine. The engine has magnetic ignition with a permanent magnet and at least one coil, and there is a fan wheel mounted on the crankshaft for cooling the engine.

BACKGROUND OF THE INVENTION

Tools of this kind are intended for portable use without being connected to an electric power system. They are guided by a person operating them and as a rule are also carried while in use. For this reason, it has always been a goal to provide tools of this kind that are as small, handy and lightweight as possible, so as to facilitate handling and especially carrying of the tool. Known tools of this type, having an externally ignited internal combustion engine, are accordingly often equipped with magnetic ignition.

In a known tool of this kind, the motor-driven chain saw Type 028 made by Andreas Stihl, a permanent magnet is disposed at the outer periphery of the fan wheel and travels past and at a slight distance apart from an iron yoke having a coil mounted thereon. The fan wheel is mounted on the crankshaft of the engine, so when the motor is running, a voltage is induced in the coil by means of the travel of the magnet past the iron yoke, and this voltage, stepped up by a transformer, serves to generate the igniting spark.

A disadvantage of the known configuration is that the fan wheel has to be relatively stable and hence heavy to hold the magnet mounted on its outer periphery. In order to avoid imbalance of the fan wheel, a counterweight must also be provided on the fan wheel, offset from the magnet by 180°. Since the centrifugal forces of these two weights increase quadratically with increasing rpm, they must be tightly anchored on the fan wheel and the latter itself must be configured to be correspondingly stable. As a result, first the fan wheel is relatively heavy, which increases the overall weight of the tool. Second, the fan wheel, revolving at a high rpm, generates strong centrifugal forces during operation, which makes handling the tool and in particular rotating it about its longitudinal axis difficult. Furthermore, the disposition of the two weights (magnet and counterweight) at least partly impedes the fan wheel in its function, because no fan blades, or only fan blades having limited functional effect are located at the region of the magnet and counterweight and this reduces the cooling air flow.

SUMMARY OF THE INVENTION

It is an object of the invention to provide a hand tool of the above type which weighs less and therefore has improved and easier handling.

This object is attained in accordance with a feature of the invention by providing a fan wheel of very light weight thereby reducing the overall weight of the tool and facilitating its handling. The lightweight configuration of the fan wheel also considerably reduces the resultant centrifugal forces, which makes handling the tool in use easier and surer. The cooling of the tool is also improved, since the cooling air flow is generated by the fan blades that are distributed over the entire periphery of the fan wheel and is not hindered by discontinuities such as a counterweight and a magnet.

The ignition arrangement according to the invention includes igniting spark generating means which permits the electrical energy generated in the exciter coil to be stored by simple means and supplied to the ignition coil at the instant of ignition; in the ignition coil, a high-voltage pulse is generated, which causes the igniting spark to spark over in the spark plug. The ignition electronics are simple and sturdy in design; the standard components used here are relatively inexpensive and can be built in in a space-saving manner, without notably increasing the weight.

According to a feature of the invention, a radial or even axial arrangement of the permanent magnet with its pole pieces relative to the fan wheel is provided; accordingly, the orientation of the projections must be in the axial or radial direction. A particularly favorable embodiment is attained if the projections are provided on a self-supporting ring made of ferromagnetic material, and the other parts of the fan wheel are of plastic; this results in a large weight reduction, with relatively low production costs.

Mounting the ignition coil on the permanent magnet or on its pole pieces provides, first, a weight reduction because a separate core for the ignition coil can be dispensed with, and second, a compact configuration.

BRIEF DESCRIPTION OF THE DRAWING

The invention will now be described with reference to the drawing wherein:

FIG. 6 is a schematic of the electronic and mechanical configuration of the ignition system; and, FIG. 7 is a circuit diagram of the ignition arrangement of the invention.

DESCRIPTION OF THE PREFERRED EMBODIMENTS OF THE INVENTION

Figure 1:
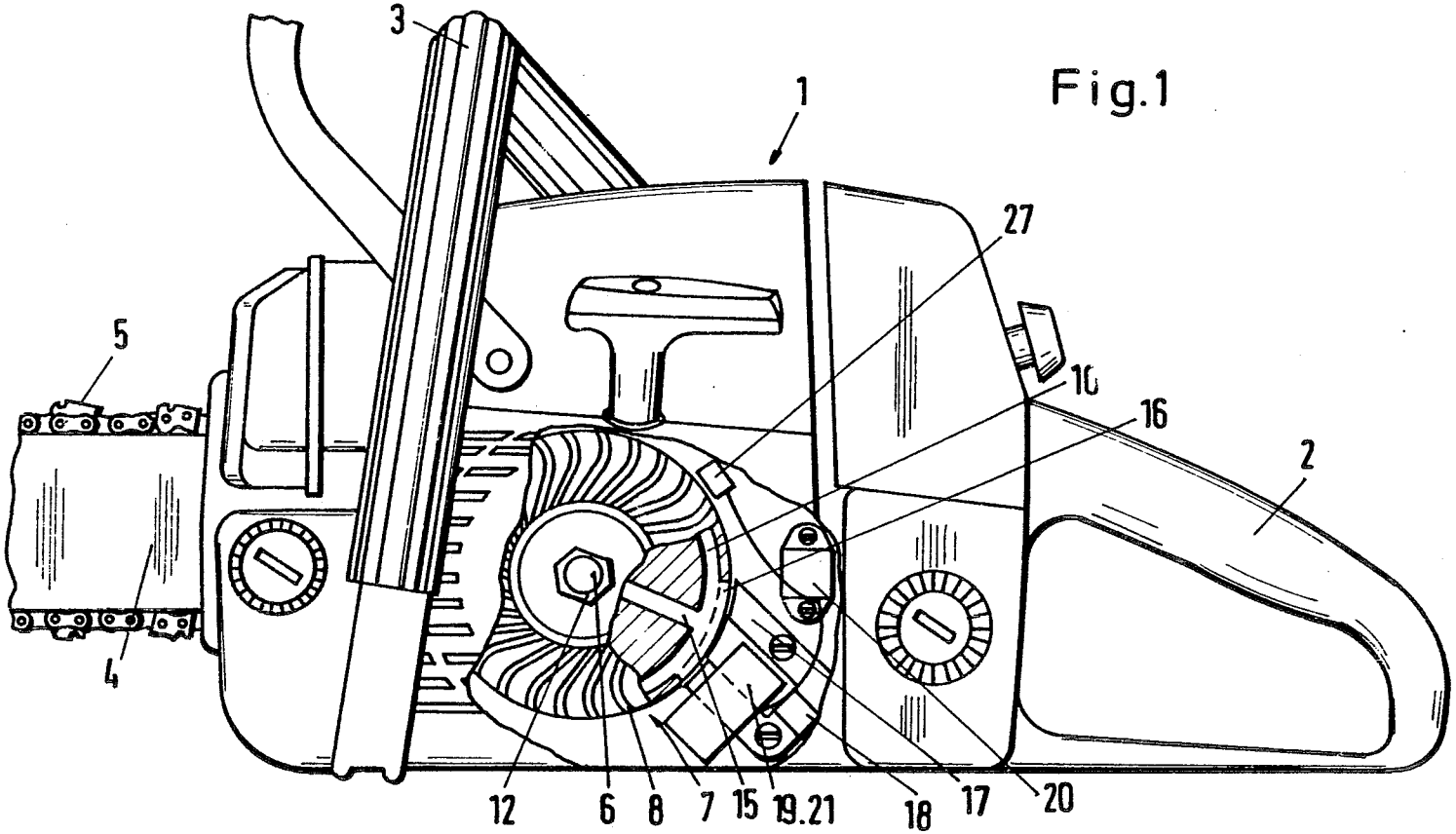
FIG. 1 is a side elevation view of a motor-driven chain saw, with a region of the housing broken out to show the ignition arrangement according to the invention.

As shown in FIG. 1, the handheld portable tool has a housing 1 with two handles 2 and 3 secured to it for carrying and guiding the tool. A guide bar 4 with a saw chain 5 revolving on it extends out of the front of the housing 1. The saw chain 5 travels inside the housing 1 via a drive sprocket, which is drive-connected via a coupling with the crankshaft 6 (the drive unit is not shown here).

As is typical with tools of this type, a one-cylinder, two-stroke engine is provided; however, the invention is not restricted to this type of engine, and in principle, other externally ignited internal combustion engines may also be used, such as multi-cylinder engines, rotary compression engines and four-stroke engines.

A fan wheel 7 is mounted on the free end of the crankshaft 6 as shown in FIG. 1 and is remote from the drive sprocket. The fan wheel 7 generates the cooling air flow required for cooling the engine.

Figure 3:
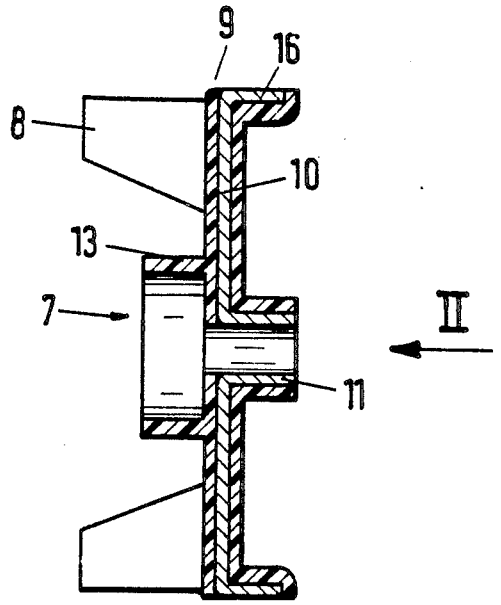
FIG. 3 is a section taken along the line III—III of FIG. 2.
Figure 2:
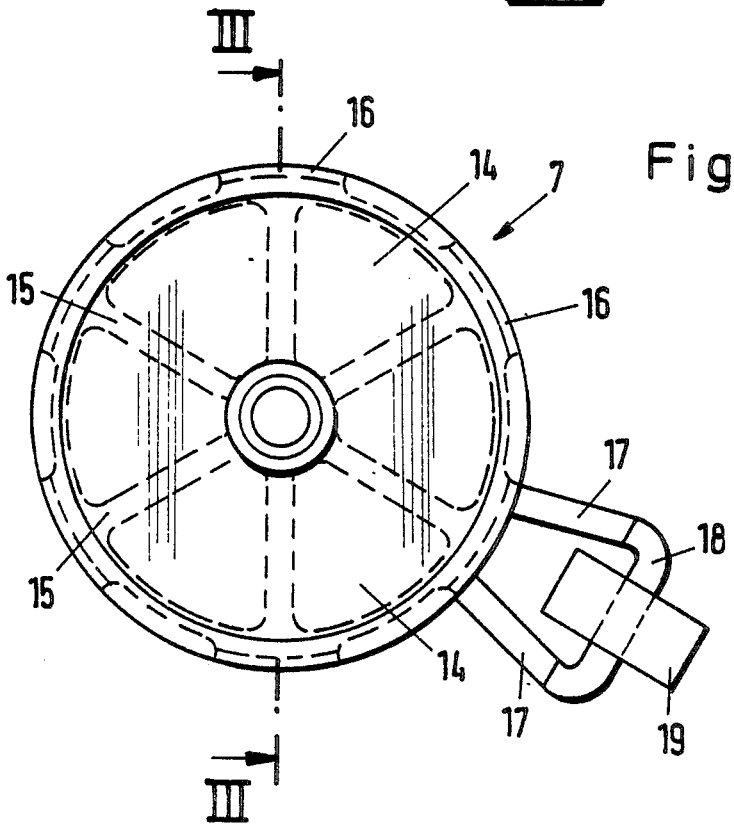
FIG. 2 is a side view, on a larger scale, of the fan wheel of FIG. 1 seen from the other side (the engine side), schematically showing the magnet and the coil.

The fan wheel 7 of the embodiment of FIG. 1 is shown in detail in FIGS. 2 and 3. The fan wheel 7 is disc-shaped in plan view (FIG. 2) and has a plurality of radially arranged blades 8, which extend from a disc-shaped part on the side of the fan wheel 7 facing away from the engine. The blades 8 extend as far as the outer periphery of the fan wheel and in the axial direction of the crankshaft 6. The fan wheel 7 has a supporting ring 10, which is made of ferromagnetic material and advantageously, as in this embodiment, is in the form of a sheet-metal ring. The supporting ring 10 extends substantially within the disc-shaped part 9 of the fan wheel 7 and is bent toward the engine, parallel to the crankshaft 6, at the outer periphery and at the inner periphery. The part of the supporting ring 10 that is bent at the inner periphery forms the hub 11 of the fan wheel, which is mounted on the crankshaft 6 for rotation therewith and is axially secured by means of a nut 12.

As FIG. 3 shows, the fan wheel 7 comprises two different materials: the supporting ring made of ferromagnetic material, and the remaining portion of the fan wheel which is advantageously made of plastic, as in this embodiment. The supporting ring 10 is embedded in plastic in this embodiment, so that it is exposed only at the outer periphery and at the inner periphery (the hub 11). All the other parts of the fan wheel 7, such as the blades 8 and an annular part 13 that surrounds the nut 12 (FIG. 1), are advantageously made of lightweight plastic. For further weight reduction, the supporting ring 10 is provided with openings 14 inside the disc-shaped part 9 of the fan wheel 7, so that the outer peripheral portion is connected to the hub 11 only by spokes 15, which are completely embedded in plastic (see FIG. 2).

Near its outer periphery, the supporting ring 10 is provided with extensions 16, which are bent at the outer periphery of the fan wheel 7 and extend parallel to the crankshaft 6. In the embodiment of FIG. 2, a total of six extensions 16 are provided on the fan wheel 7, which are distributed at equal intervals on the outer periphery of the fan wheel 7. As FIG. 2 shows, the bentover parts of the extensions 16 travel past the pole pieces 17 of a permanent magnet 18 with a small spacing being provided between the pole pieces 17 and the extensions 16. A coil 19 is mounted on the permanent magnet 18.

During operation, a change in the magnetic flux is brought about by the extensions 16 as they travel past the pole pieces, and this induces a voltage in the coil 19. The electrical energy generated in this way is stored in a storage and control unit 20 connected to the coil 19 and supplied at the intended instant of ignition to an ignition coil 21, in which the voltage required for generating the igniting spark is stepped up.

FIGS. 1 to 3 illustrate a radial arrangement; that is, the pole pieces 17 of the permanent magnet 18 are arranged in the radial direction of the fan wheel 7. This arrangement is particularly advantageous if the axial depth of the apparatus is to be minimal. For instance, if it is impossible to mount the magnet 18 and coil 19 at the outer periphery of the fan wheel 7, then the embodiment shown in FIGS. 4 and 5 can be used, in which the pole pieces of the magnet 18 are axially mounted, that is, parallel to the axis of rotation of the fan wheel 7A. The mode of operation of the embodiment shown in FIGS. 4 and 5 is the same as that described above; by the alternating opening and closing of a magnetic circuit, a voltage is induced in the coil 19 which is used, via the electronics of the storage and control unit 20, to be described below, for generating the igniting spark in the engine.

Figure 5:
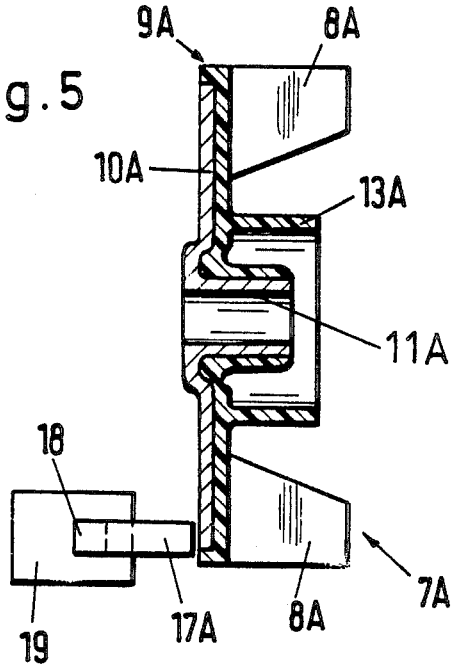
FIG. 5 is a section taken along the line V—V in FIG. 4.
Figure 4:
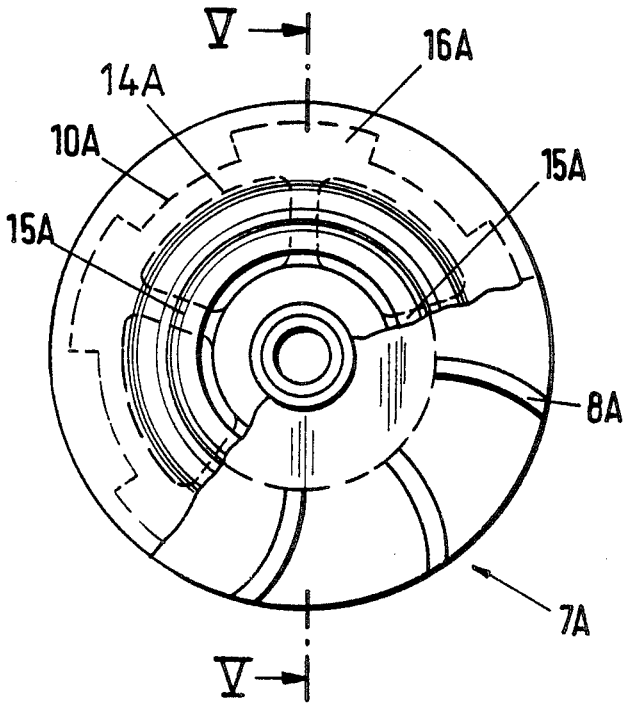
FIG. 4 is a further embodiment of the fan wheel, in a view corresponding to FIG. 2.

The fan wheel 7A shown in FIGS. 4 and 5 has a disc-shaped part 9A, on which are mounted radially extending blades 8A, which are spaced from an annular part 13A and extend as far as the outer periphery of the fan wheel 7A. The fan wheel 7A has a supporting body 10A made of ferromagnetic material, which is configured similarly to the supporting body 10 of the embodiment of FIGS. 2 and 3. The supporting body 10A extends from the inner periphery of the fan wheel 7A, where it is configured as a hub 11A, in a substantially disc-shaped manner to near the outer periphery of the fan wheel 7A.

As FIG. 4 shows, openings 14A are also provided in the disc-shaped supporting body 10A, forming spokes 15A between the outer periphery and the hub 11A of the supporting body 10A. The supporting body 10A is substantially flat in form and extends to near the periphery of the fan wheel 7A. At the periphery, the fan wheel 7A is provided with projections 16A distributed uniformly over the periphery. In this embodiment as well, five projections 16A are provided, which as FIG. 5 shows, travel past and are slightly spaced from the pole pieces 17A of the permanent magnet 18. In this embodiment too, the supporting body 10A is advantageously embedded in lightweight plastic, and the side of the supporting body 10A facing toward the magnet 18 as well as the inside of the hub 11A are exposed, so that the projections 16A travel past the pole pieces 17A at a minimal spacing therefrom and thus bring about the maximum possible change in the magnetic flux.

Since the change in flux generated by the projections 16, 16A traveling past the pole pieces 17 during operation is relatively small in comparison to the flux change (or flux alternation) brought about by a rotating magnet, the invention includes a plurality of projections 16, 16A and a corresponding storage and control unit 20, by which the required ignition energy is provided.

FIG. 6 shows the configuration of the ignition arrangement; for the sake of clarity, only two of the plurality of projections 16 or 16A on the fan wheel 7 are shown here by way of example. As shown in FIG. 6, the ignition coil 21 is mounted on the same iron yoke as the coil 19. This is not absolutely required, but it is very useful in terms of saving space. The exciter coil 19 is connected with one terminal to the common ground 22; its other terminal is connected to one input 23 of the storage and control unit 20, which is likewise connected with one terminal to the common ground 22. An output 24 of the storage and control unit 20 is connected to the ignition coil 21, the primary and secondary winding of which is connected with one end to ground and the secondary winding of which, carrying the high voltage, is connected with its other end to the middle electrode of a spark plug 25. The ground electrode of the spark plug 25 is connected to the common ground 22. It will be understood that when the ignition system is used with multi-cylinder engines, a suitable distributor is provided between the high-voltage output of the ignition coil 21 and the middle electrodes of the spark plugs.

The storage and control unit 20 furthermore has a control input 26, which is connected to a sensor 27 mounted near the outer periphery of the fan wheel 7. Via the sensor 27, the instant of ignition is controlled;

for this purpose, an appropriate marking is provided on the outer periphery of the fan wheel 7, which the sensor 27 detects. The marking and the sensor may cooperate in a known manner, either capacitively, inductively, opto-electronically or mechanically.

FIG. 7 shows the configuration of the storage and control unit 20, in which the electrical energy induced by the coil 19 is stored and is supplied to the ignition coil 21 at the instant of ignition. A diode 28 and a capacitor 29 connected in series are connected parallel to the input 23 of the unit 20. A thyristor 30 is connected to the circuit node between the diode 28 and capacitor 29 and is connected to the output 24 of the unit 20. The control electrode of the thyristor 30 is acted upon by a pulse transducer 31, which is controlled at the input 26 by the sensor 27.

Upon rotation of the crankshaft 6, the projections 16 of the fan wheel 7 travel past the pole pieces 17 of the magnet 18 and effect a change in magnetic flux, causing the induction of a voltage in the coil 19. The voltage is rectified by the diode 28, so that the capacitor 29 is charged when there is a change in flux in the magnetic circuit 16, 17, 18. The capacitor 29 is discharged when the sensor 27 triggers the pulse transducer 31 and thereby makes the thyristor 30 conductive, causing the capacitor voltage to be applied to the primary winding of the ignition coil 21 and causing the discharge current to induce a voltage that is stepped up by transformation in the ignition coil, so that the igniting spark that sparks over in the spark plug 25 is generated via the secondary winding.

The invention is not limited to the ignition system shown in FIGS. 6 and 7; for instance, a battery can also be charged via the coil 19 and the battery can supply a battery ignition system. What all the embodiments have in common, however, is the supply of energy to the ignition system by means of the voltage induced in the coil 19, which is brought about by the change in flux in the magnetic circuit; the permanent magnet 18 is stationary here, along with the coil 19, and the projections 16 or 16A open and close the magnetic circuit in alternation as the crankshaft 6 rotates. The disposition of the marking and of the sensor 27 on the outer periphery of the fan wheel 7 is particularly advantageous, since the instant of ignition can then be set very accurately, because of the relatively large periphery of the fan wheel 7; the sensor 27 and the associated marking may, however, instead be disposed on the crankshaft 6, on a drive wheel mounted thereon, or on some other part that rotates in a slip-free manner with the crankshaft.

The supporting ring 10 or supporting body 10A shown in FIGS. 2 to 5 need not necessarily extend as far as the hub 11 or 11A; depending on the material used, a self-supporting ring having projections 16 or 16A on the outer periphery of the fan wheel 7 or 7A may suffice, having for instance a shape like the outer ring of the supporting ring 10 or the supporting body 10A.

The embodiments described herein are particularly advantageous, however, because they have great stability while being lightweight and having relatively low production costs. By embodying the hub 11 of metal, a secure seat on the crankshaft 6 is assured; the surrounding plastic may have relatively low strength, because it is reinforced by the supporting body 10. The fans wheels 7 or 7A shown here have great stability yet are lightweight, and they can be manufactured relatively simply and inexpensively; because of its low weight and its security against becoming imbalanced, there is no need to provide counterbalancing for the fan wheels.

It is understood that the foregoing description is that of the preferred embodiments of the invention and that various changes and modifications may be made thereto without departing from the spirit and scope of the invention as defined in the appended claims.

What is claimed is:

1. An ignition arrangement for an internal combustion engine of a handheld portable tool, the engine having a crankshaft and the ignition arrangement comprising:

a permanent magnet having at least one pole shoe;

a fan wheel mounted on the crankshaft of the engine for rotation therewith and for generating a flow of cooling air for cooling the engine, the fan wheel including:

an annular metal supporting member mounted on the crankshaft of the engine for rotation therewith and extending radially from the crankshaft; and, a plastic disc-like member mounted on said supporting member and defining a plurality of vanes for generating said flow of cooling air;

said supporting member being made of ferromagnetic material and having a plurality of projections formed thereon and extending therefrom so as to pass said one pole shoe as the crankshaft rotates;

said projections and said permanent magnet conjointly defining a magnetic circuit wherein the flux varies as said projections pass said pole shoe; and, igniting spark generating means operatively connected to said permanent magnet and responsive to the variations in said flux for generating a spark for the engine.

2. The ignition arrangement of claim 1, wherein said handheld portable tool is a chain saw; and, said igniting spark generating means comprising an exciter coil mounted on said magnet for generating the energy required for causing said spark; and, storage means for storing said energy.

3. The ignition arrangement of claim 2, said storage means including a capacitor and a diode connected between said coil and said capacitor.

4. The ignition arrangement of claim 2, said igniting spark generating means comprising ignition coil means for generating an ignition voltage for causing said spark; and, switch means for passing said energy from said storage means to said ignition coil means.

5. The ignition arrangement of claim 4, comprising: actuating means for providing an actuating signal for actuating said switch means at a predetermined instant, said actuating means including an actuating element mounted on said fan wheel and a sensor mounted next to said fan wheel for responding to the passage of said element to issue said actuating signal.

6. The ignition arrangement of claim 4, said ignition coil means being mounted on said magnet.

7. The ignition arrangement of claim 4, said self-supporting annular member and said projections thereof being configured as a disc and being mounted in said fan wheel so as to be on the side thereof facing toward the engine.

8. The ignition arrangement of claim 7, said projections being evenly distributed about the periphery of said annular member.

9. The ignition arrangement of claim 1, said permanent magnet having two pole shoes; and , the crankshaft defining a rotational axis and said pole shoes being mounted so as to extend in the direction of said axis.

10. The ignition arrangement of claim 1, said permanent magnet having two pole shoes; and, the crankshaft defining a rotational axis and said pole shoes being mounted radially of said axis.

11. The ignition arrangement of claim 1, said annular member being at least partially embedded in said plastic disc-like member.

12. The ignition arrangement of claim 1, the crankshaft defining a rotational axis and said projections being arranged in the region of the outer periphery of said annular member, said projections being bentover so as to extend in the direction of said axis.

13. A handheld portable tool comprising:

a housing;

tool means for performing work on a workpiece;

an engine mounted in said housing and having a crankshaft operatively connected to said tool means for driving the latter;

a permanent magnet fixedly mounted on said housing and having pole shoe means;

a fan wheel for generating a flow of cooling air for cooling said engine, said fan wheel including:

an annular metal supporting member mounted on the crankshaft of the engine for rotation therewith and extending radially from the crankshaft; and, a plastic disc-like member mounted on said supporting member and defining a plurality of vanes for generating said flow of cooling air;

said supporting member being made of ferromagnetic material and having a plurality of projections formed thereon and extending therefrom so as to pass said pole shoe means as the crankshaft rotates;

said projections and said permanent magnet conjointly defining a magnetic circuit wherein the flux varies as said projections pass said pole shoe means; and, igniting spark generating means operatively connected to said permanent magnet and responsive to the variations in said flux for generating a spark for the engine.

14. The handheld portable too of claim 13, wherein said handheld portable tool is a chain saw; and, said igniting spark generating means comprising an exciter coil mounted on said magnet for generating the energy required for causing said spark; and, storage means for storing said energy.

15. The handheld portable tool of claim 14, said storage means including a capacitor and a diode connected between said coil and said capacitor.

16. The handheld portable tool of claim 14, said igniting spark generating means comprising ignition coil means for generating an ignition voltage for causing said spark; and, switch means for passing said energy from said storage means to said ignition coil means.

17. The handheld portable tool of claim 16, comprising: actuating means for providing an actuating signal for actuating said switch means at a predetermined instant, said actuating means including an actuating element mounted on said fan wheel and a sensor mounted next to said fan wheel for responding to the passage of said element to issue said actuating signal.

* * * * *